US005748152A

United States Patent [19]

Glabe et al.

[11] Patent Number: 5,748,152

[45] Date of Patent: May 5, 1998

[54] BROAD BAND PARALLEL PLATE ANTENNA

[75] Inventors: John R. Glabe, Ramona; Edward L. Pelton, San Diego, both of Calif.

[73] Assignee: McDonnell Douglas Corporation, Huntington Beach, Calif.

[21] Appl. No.: 365,046

[22] Filed: Dec. 27, 1994

[51] Int. Cl.[6] ..... H01Q 13/10

[52] U.S. Cl. ..... 343/767; 343/770; 343/705

[58] Field of Search ..... 343/767, 770, 343/705, 809

[56] References Cited

U.S. PATENT DOCUMENTS

| | | | |
|---|---|---|---|
| 5,025,264 | 6/1991 | Stafford | 343/767 |
| 5,081,466 | 1/1992 | Bitter, Jr. | 343/767 |
| 5,311,199 | 5/1994 | Fraschilla et al. | 343/767 |
| 5,404,146 | 4/1995 | Rutledge | 343/770 |
| 5,428,364 | 6/1995 | Lee et al. | 343/767 |

*Primary Examiner*—Hoanganh T. Le
*Assistant Examiner*—Tan Ho
*Attorney, Agent, or Firm*—Ronald L. Taylor

[57] ABSTRACT

A broadband flared slot notch antenna combined with an overhead metal plate resulting in an improved front-to-back ratio and a reduced response to crossed polarized radiation. The antenna is provided by a metal layer deposited on a dielectric substrate which is etched to form a pair of symmetrical slot sections having facing edges which increasingly curve away from each other to a maximum spacing point which is the antenna aperture. A linking slot interconnects the slot sections at a feed point spaced from the aperture. High frequency electrical voltage applied at the feed point achieves launch of an electromagnetic wave from the aperture. The overhead metal plate is parallel and closely spaced above and shorted to the antenna thereby reducing radiation emissions that are not in the direction of that launched from the aperture. The metal plate is shorted to the antenna along a line orthogonal and adjacent to the linking slot to prevent radiation from being launched in a direction opposite that described above. The forward edge of the metal plate is terminated with a tapered resistive card to prevent radiation scatter off the edge. The back portion of the space enclosed by the plane of the antenna and the metal plate may be filled with electromagnetic radiation absorbing material to further reduce such radiation. In addition, the sides of the metal plate, may be partially or completely closed with metal walls that are shorted to the metal plate for reducing radiation emissions that are orthogonal to that launched from the aperture.

43 Claims, 3 Drawing Sheets

BROAD BAND PARALLEL PLATE ANTENNA

BACKGROUND OF THE INVENTION

The present invention relates generally to a non-resonant antenna, and, more particularly, to such an antenna with flared notch slot elements and an overhead plate exhibiting a broad operating bandwidth and capable of providing directive radiation with increased front to back ratio and reduced crossed polarized radiation response.

DESCRIPTION OF THE RELATED ART

A typical form of microwave antenna utilizing circuit board techniques for construction includes first and second electrodes laid down on a common surface of an insulative substrate, which electrodes have tapering facing portions to provide a continuously increasing spacing between the electrodes until a maximum is reached at the forward most end. When used in the transmission mode, electrical energy is applied at the closely spaced end and the electromagnetic signal is launched from the opposite end in what is termed an end-fire manner. The polarization of the launched signal is typically linear, with the polarization parallel to the plane of the electrodes. Such microstrip dipole antennas have wide application and are especially advantageous where a large number of individual antennas are arranged in an array for ultimate use. One example of an antenna of this general category is that disclosed in U.S. Pat. No. 3,947,850.

SUMMARY OF THE INVENTION

In the practice of the present invention, a flared notch slot antenna is combined with an overhead metal plate. The antenna is fabricated by first depositing a metallic layer onto a surface of an insulative substrate. The metal layer is etched away to form a shaped slot having a pair of spaced apart slot sections which extend from a narrowly spaced first end along a substantially parallel transition portion and then along continuously curved and widening slot section edges to a maximum spacing at the opposite end. The maximum non-parallel, separated slot section ends form the antenna radiating aperture in transmission mode and include a furtherance of the shaped slot sections extending from the wide ends of the slot sections to form a termination. The termination slots are covered with a thin layer of a lossy material to absorb electromagnetic energy not radiated form the aperture. An example of such an antenna is shown and described in the patent application having the U.S. Pat. No. 241,565 which was filed on May 12, 1994.

The metal plate for the antenna is fabricated by placing it over the antenna so as to be relatively closely spaced and parallel to thereto. A rear wall is disposed between the metal plate and the antenna at the back of the antenna to function as a short therebetween thereby reducing radiation that is directed opposite to that launched from the aperture. A tapered resistance may be placed on the forward edge of the metal plate to prevent radiation scatter off said edge. Radiation absorbing material may also be placed between the metal plate and the antenna adjacent to the rear wall to provide further radiation absorption. In addition, side walls may be placed on either side of the metal plate to prevent lateral radiation emission.

Because of the general aspects of the microstrip slot construction (i.e., relatively thin), the antenna and the metal plate combination lends itself to readily being applied to a conformal use, in that it can be located completely within the wall of a cavity on the exterior surface of an aircraft, for example, and still provide optimal operation. When so mounted, the cavity is preferably lined with an absorbing material to prevent undesirable re-radiation of inwardly directed radiation.

The described antenna is especially advantageous in providing an extremely broad operating bandwidth for a slot type radiator (e.g., 600% bandwidth has been demonstrated). Also, increased gain and directive operation may be obtained as well as conformal mounting already mentioned. The polarization of the radiated signal is linear and perpendicular to the conductive surface containing the slot. In particular, the combination of the metal plate and the antenna results in reduced response to crossed polarized radiation and an increased front to back ratio.

DETAILED DESCRIPTION OF THE PREFERRED EMBODIMENT

Figure 1:
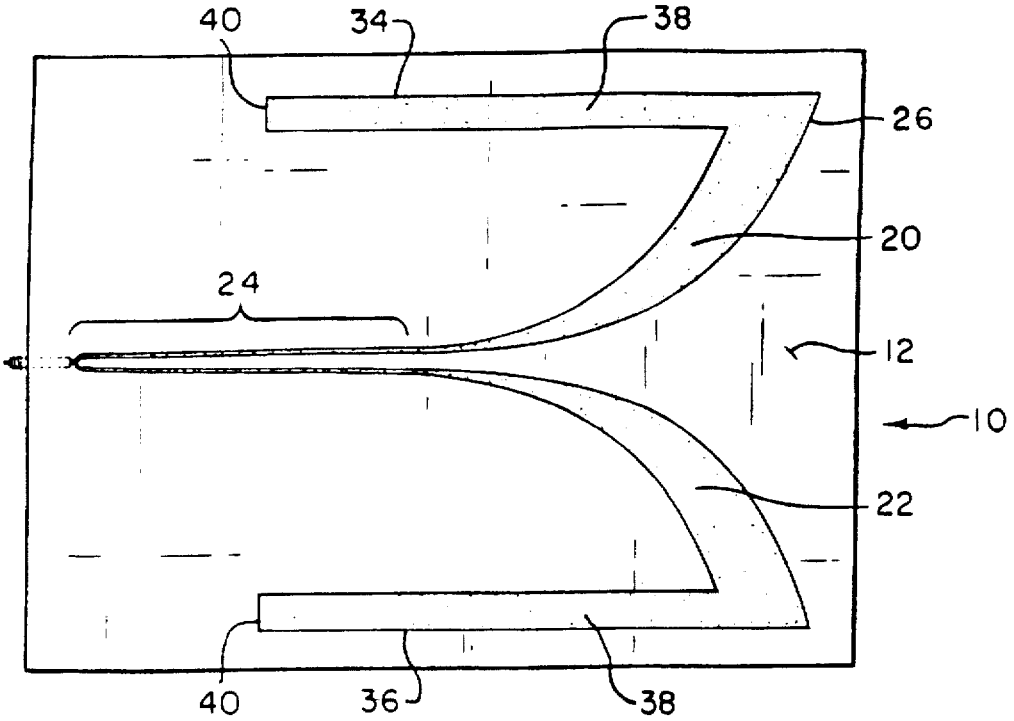
FIG. 1 is a top plan view of the antenna.

Turning now to the drawings, the invention to be described is enumerated as 10 and in its general constructional aspects is a nonresonant microstrip slot antenna combined with an overhead metal plate 60. Constructionally, the antenna 10 to be described is formed from a relatively thin metal layer 12 (e.g., copper) deposited on a major surface 14 of an electrically insulative substrate 16. Satisfactory materials for making the substrate 14 and the techniques involved in depositing the metal layer 16 onto the substrate can be those typically utilized in the making of so-called circuit boards.

Figure 5:
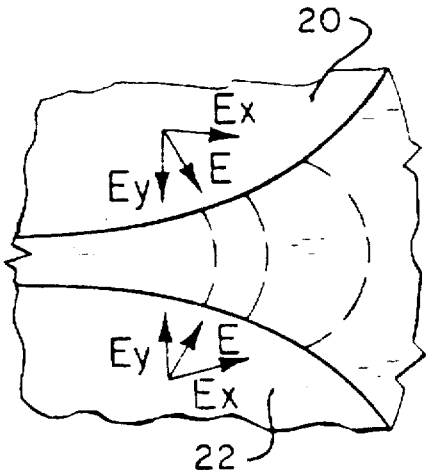
FIG. 5 is an enlarged, partially fragmentary plan view of the antenna slot sections of FIG. 1.

With reference particularly to FIGS. 1 and 5, it is seen the metal layer 12 has been etched away to leave first and second slot sections 20 and 22 of identical symmetrical shape. More particularly, each slot section includes a transition portion 24 where the slot width is very narrow and the two transition portions are substantially parallel in slightly spaced apart relation. On moving forwardly of the transition portion toward what is the electromagnetic energy launching end or aperture 26, the lateral metal edges of the two slot sections are continuously curved away from each other to substantially increase each slot section width to a maximum at the aperture while at the same time separating the two slot sections by an increasing extent of intervening metal layer. As will be more particularly described, the two symmetrical slot sections 20 and 22 serve as the two antenna elements that form the slot antenna of this invention.

Figure 3:
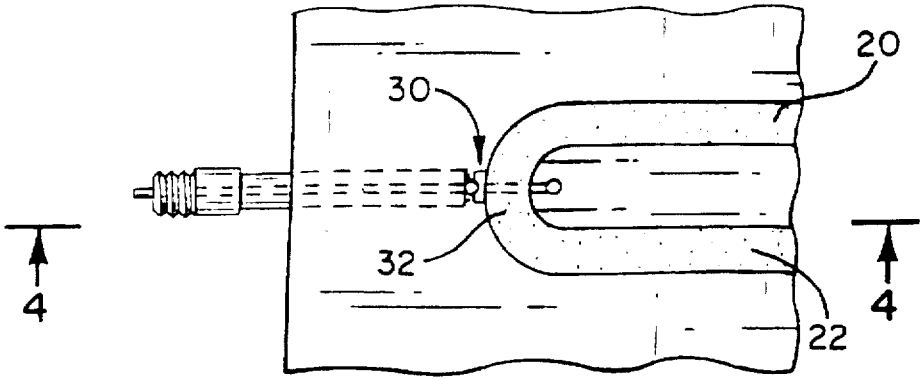
FIG. 3 is an enlarged detailed view showing the antenna feed point.

Reference is now made to the enlarged view of that part of the antenna slot shown in FIG. 3 which is the feed point 30 for the antenna (i.e., where electrical energy is applied during transmission mode or where processing equipment is connected in the reception mode). It is to be noted that the outer ends of the two slot transition portions 24 are joined by a linking slot 32, so that the slot sections and linking slot actually form a single slot with all of the various slot parts in communication with each other.

Returning once again to FIG. 1, the outer ends of the slot sections at the aperture 26 are seen to include slot portions extending rearwardly generally parallel to each other and to the slot transition 24 forming terminations 34 and 36 for the antenna. The specific termination configuration shown was selected primarily to minimize the overall aperture dimensions, but otherwise the termination portions may extend generally outwardly other than in the depicted parallel directions and still provide satisfactory antenna operation. By use of a resistive spray, for example, a tapered resistance 38 is provided along each termination which is in the range of 1000–2000 ohms at the aperture to very nearly 0 ohms at the termination end 40 for absorbing signals not radiated at the aperture.

Figure 4:
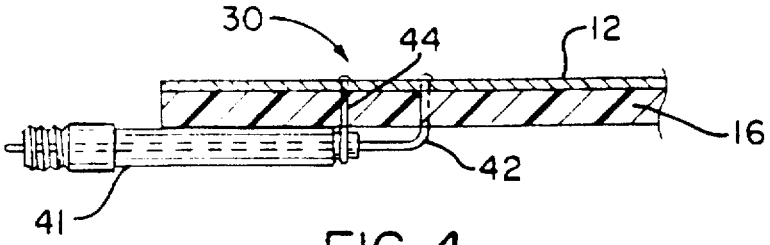
FIG. 4 is a side elevational sectional view of FIG. 3 taken along the line 4—4.

In transmission use as shown in FIG. 4, the electrical energy is applied to the feed point 30 via, say, a coaxial cable 41 with the center conductor 42 and outer shield conductor 44 after passing through openings in the dielectric substrate being connected to the metal layer 16 at points on opposite sides of the linking slot 32. There is little or no radiation in the closely spaced parallel slot portions in the transition region 24 due to counter-phasing of the parallel slot fields, so the signal propagates in a forward direction toward the aperture. As the slot sections 20 and 22 become more non-parallel, the transverse component E of the slot field become additive (i.e., in phase) and as a result radiation is initiated in these portions of the slot sections. In more detail, as shown in FIG. 5, the Ey components of the fields in the two slot sections will act to cancel one another while the B components (the field components essentially perpendicular to the respective slot sections) are directed toward the antenna aperture and aid one another when the slot sections curve away from each other. Also, the Ex components move in the same direction toward the aperture adding to one another and radiating.

It is preferable that the substrate with the described antenna 10 be positioned within an enclosure 46 having a unitary bottom 48 and side walls 50 constructed of an electromagnetic energy absorbing material (e.g., synthetic thermoplastic). Orientation of the antenna within the enclosure is such that the metal layer and slot sections face outwardly through the enclosure open top 52. The enclosure bottom and side walls absorb radiation and, in that way, prevents undesirable inward radiation and possible re-radiation.

Figure 2:
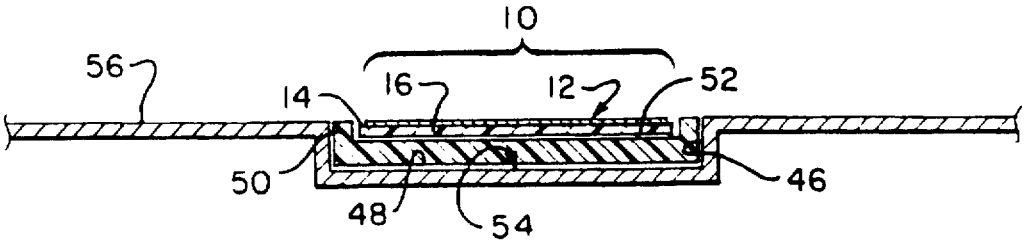
FIG. 2 is a side elevational, sectional view of the antenna of FIG. 1 showing it conformally mounted within a cavity.

An advantageous feature of the present invention is that it can be conformally mounted. As shown best in FIG. 2, the antenna 10 received within the enclosure 46 is located within a cavity 54 formed in the outer surface 56 of an aircraft, for example, with none of the antenna parts extending beyond the surface into the wind stream which is desirable from an aerodynamic standpoint.

Figure 6:
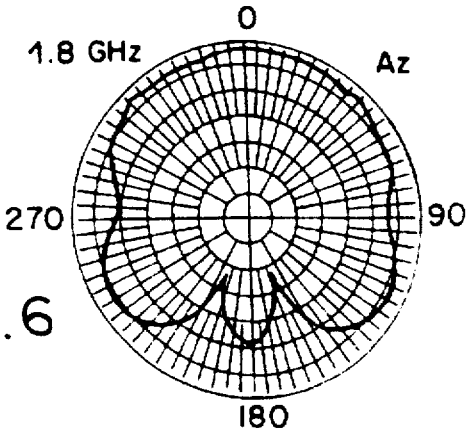
FIG. 6 depicts graphs of radiation patterns obtained for the described antenna.

The graphs in FIG. 6 represents radiation patterns obtained from test of a practical construction of the described antenna. During test running from which this graph was taken the antenna plane was oriented with the aperture directed toward 0 degrees and the polarization was such that the E field was orthogonal to the antenna plane.

Figure 7:
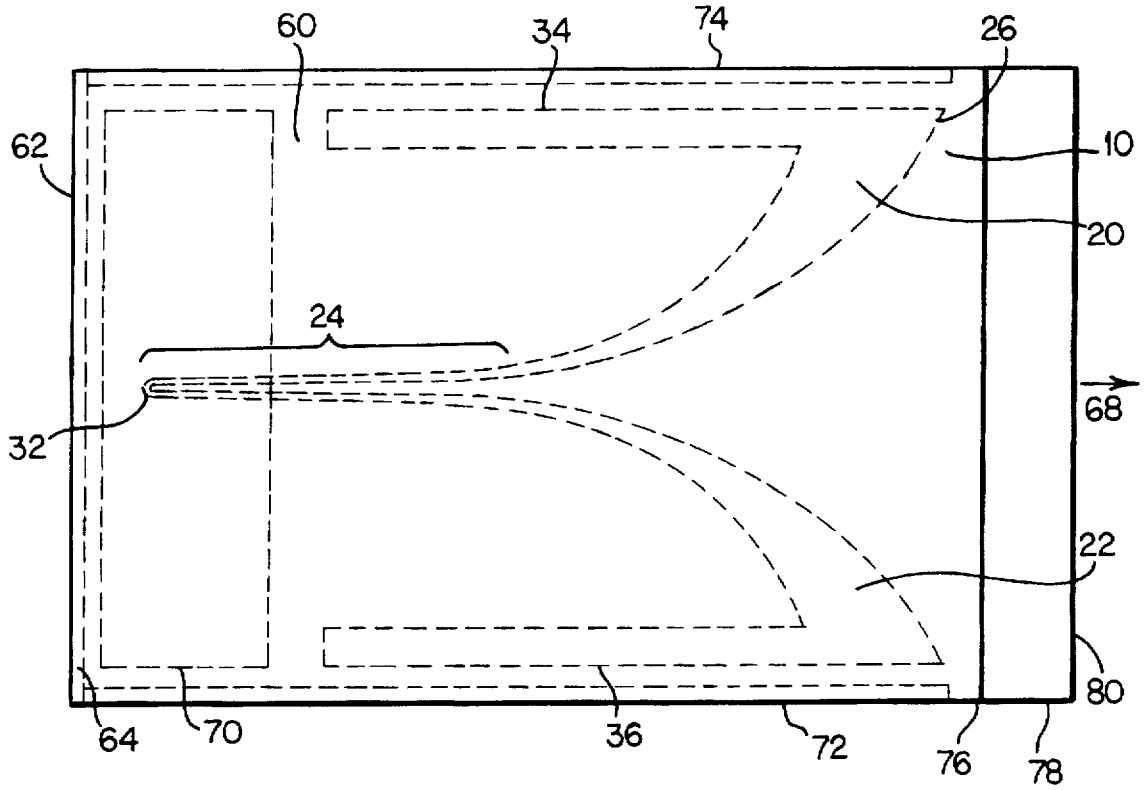
FIG. 7 is a top plan view of the combined metal plate and antenna of the present invention.
Figure 8:
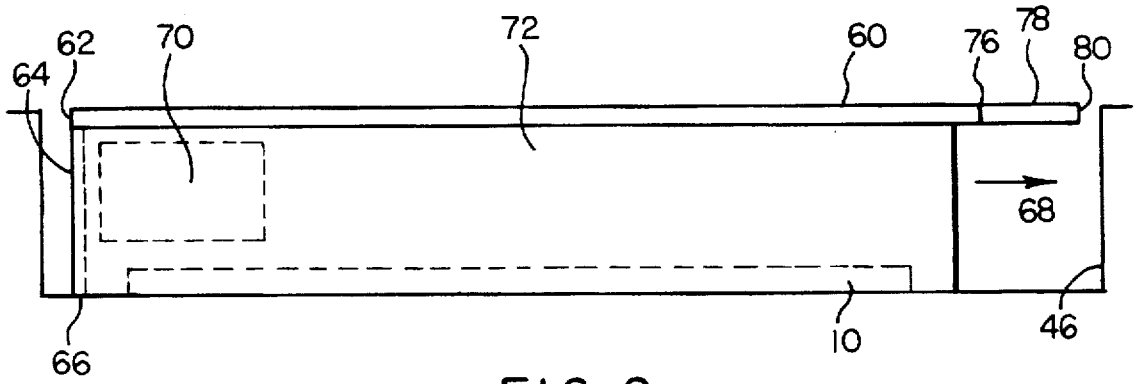
FIG. 8 is a side elevational, sectional view of the combined metal plate and antenna of FIG. 7.

As shown in FIG. 7 and 8, a top metal plate, sheet or layer of copper or other conductive material 60 is disposed above the antenna 10 so as to be closely spaced and parallel or nearly parallel to the antenna 10. The metal plate 60 having the back edge 62 and a forward edge 76 which is relatively transverse to an axis defined by the transition portion 24. To prevent radiation leakage out the back, the back edge 62 of the metal plate 60 is shorted or grounded to the antenna 10 by means of a back or rear metal plate 64 of copper or other conductive material which is nearly perpendicular or orthogonal to the metal plate 60 and the antenna 10. The bottom edge 66 of the rear metal plate 64 is disposed in back of the linking slot 32. Also, the rear metal plate 64 is relatively transverse to the axis defined by the symmetrical slot sections 20 and 22. Insomuch as the direction 68 of the electromagnetic radiation in this embodiment is desired to be from the transition portion 24 towards the antenna aperture 26, the shorted back plate 64 acts to stop and absorb radiation in the opposite direction thereto.

To supplement the rear plate 64 in regards to the absorption of radiation not in the direction of launch 68 which is along an axis defined by the transition portion 24, a block or body 70 of radiation absorbing material may be inserted into the space forward of the back plate 64 and in between the metal plate 60 and the antenna 10. The preferred radiation absorbing material for the block 70 being generically known as open cell urethane foam loaded with carbon in several layers and a specific type being model AN type graded absorber manufactured Emerson-Cummings.

A pair of side walls or plates 72, 74 may also be provided to absorb electromagnetic radiation not in the direction of launch 68 and in particular that radiation which is emitted perpendicular to the launch direction 68. The side walls 72, 74 may be disposed perpendicular to and between the metal plate 60 and the antenna 10. The side walls 72, 74 are further disposed to be aligned and relatively parallel to an axis defined by the transition portion 24. The maximum length of the side walls 72, 74 are defined by the back edge 62 and forward edge 80 of the metal plate 60. Each of the side walls 72, 74, are further positioned to be away from the side of its adjacent respective termination 34, 36 that is opposite the transition portion 24. Depending on the amount of electromagnetic absorption desired, the side walls 72, 74 may entirely enclosed the sides as shown or only partially enclose the sides. Entire enclosure of the side by the side walls 72, 74 would include all of the side adjacent to the terminations 34, 36. The side walls are to be constructed of a conductive material or metal such as copper.

To prevent, minimize, reduce or decrease radiation emission or dispersal that is non incident to the launch direction 68 or radiation scattering or diffraction off the forward edge 76 of metal plate 60, a tapered resistance card, sheet or layer 78 is provided as an extension of the metal plate off the forward edge for a relatively short distance beyond the antenna aperture 26. The card 78 is made of a nonconductive or resistive material such as Kayton film which is coated with conductive ink relatively heavily at the edge of the card that meets with the forward edge 76 of the metal plate 60 so as to be of a relatively low resistance and coated relatively lightly at the opposite edge 80 so as to be of a relatively high resistance and thereby prevent electromagnetic scattering or dispersal off the edge 80 that is nonincident to the direction of radiation launched from the aperture.

In the practice of the present invention there is provided a microstrip receiving/transmitting antenna 10 having a very low profile enabling conformal mounting such as within a cavity formed in the outer surface of an aircraft, for example. A broad operating bandwidth is achieved exceeding that of the more conventional slot antennas, with actual tests showing 600% obtainable. Still further the antenna may be readily modified for high directivity use by narrowing or expanding the antenna aperture accordingly. The addition of the metal plate 60, rear wall 64, side walls 72,74, absorber block 70, and tapered resistive card 78 provides for wider bandwidth, better directivity, improved front-to-back ratio, and reduced response to crossed polarized radiation. The front-to-back ratio is the magnitude of radiation in the forward direction over the magnitude of the radiation in the back direction.

Although the invention has been described in connection with a preferred embodiment, it is to be understood that those skilled in the appertaining arts may conceive of modifications that come within the spirit of the invention as described and the ambit of the appended claims.

What is claimed is:

1. A broadband slot antenna, comprising:

a generally planar electrically conductive sheet;

a portion of the conductive sheet being removed to form a single slot, said slot including a pair of symmetrical slot sections having facing edges separated by an unbroken extent of said conductive sheet, and a linking portion of the slot interconnecting the two slot sections at a first end of each slot section;

said conductive sheet having a transition portion extending away from the first ends of the slot sections where the facing edges of the slot sections are substantially parallel to one another, and beyond the transition portion where the facing edges of the slot sections continuously curve away from each other to form a radiating aperture therebetween;

an electromagnetic energy absorbing body enclosing the electrically conductive sheet, slot sections, and linking portion leaving one major side of the conductive sheet and slot sections free;

a conductive plate disposed above and grounded to said conductive sheet; and a resistive card abutting and extending from a side of said conductive plate that is proximate to the radiating aperture of the facing edges of the slot sections for minimizing the dispersal of electromagnetic radiation that would otherwise scatter from the side of said conductive plate.

2. A broadband slot antenna as in claim 1 in which said conductive plate is relatively closely spaced to said conductive sheet.

3. A broadband slot antenna as in claim 1 in which said conductive plate is constructed of copper.

4. A broadband slot antenna as in claim 1 including a back plate that is conductive and relatively disposed above and back of said linking portion for minimizing electromagnetic radiation directed towards said linking portion.

5. A broadband slot antenna as in claim 4 in which said back plate is transverse to the slot section facing edges.

6. A broadband slot antenna as in claim 4 in which said back plate is relatively orthogonal to both the conductive plate and the conductive sheet.

7. A broadband slot antenna as in claim 4 in which said conductive plate is grounded to said conductive sheet through said back plate.

8. A broadband slot antenna as in claim 4 including electromagnetic radiation absorbing material disposed between said conductive plate and said conductive sheet while being relatively adjacent to said back plate.

9. A broadband slot antenna as in claim 8 in which said electromagnetic radiation absorbing material is an open cell type urethane foam loaded with carbon.

10. A broadband slot antenna as in claim 8 in which said electromagnetic radiation absorbing material is a graded absorber.

11. A broadband slot antenna as in claim 1 in which said resistive card is tapered to have a resistance that increased with distance from said conductive plate.

12. A broadband slot antenna as in claim 1 in which said resistive card is a non-conductive film sprayed with a conductive ink to vary the resistance on any part of the film depending on the amount of the ink sprayed thereon.

13. A broadband slot antenna as in claim 1 including a pair of conductive wall plates relatively aligned with the respective transition portion of said conductive sheet and disposed between said conductive plate and said conductive sheet for absorbing electromagnetic radiation.

14. A broadband slot antenna as in claim 13 in which said conductive wall plates are electrically grounded to said conductive plate.

15. A broadband slot antenna as in claim 13 in which said conductive wall plates are constructed of copper.

16. A broadband microstrip antenna, comprising:

a dielectric substrate;

a metal layer on a surface of the substrate;

first and second spaced apart slot sections formed in the metal layer having facing edge surfaces that continuously taper away from one another from a minimum spacing at a first end to a maximum spacing at a second end;

a linking slot formed in the metal layer interconnecting the first and second slot sections adjacent the first end of each;

a conductive sheet disposed above the first and second spaced apart slot sections, the conductive sheet having a first edge adjacent to the first ends and a second edge adjacent to the second ends, both the first and second edges being relatively transverse to the axis defined by the first and second ends; and a resistive sheet having a first edge and an opposite second edge attached to the second of the conductive sheet for reduced scattering of electromagnetic radiation from the second edge of the conductive sheet.

17. A broadband microstrip antenna as in claim 16 in which the conductive sheet is relatively closely spaced to the first and second spaced apart slot sections.

18. A broadband microstrip antenna as in claim 16 in which the conductive sheet is relatively parallel to the first and second spaced apart slot sections.

19. A broadband microstrip antenna as in claim 16 in which the conductive sheet is constructed of copper.

20. A broadband microstrip antenna as in claim 16 includes a conductive wall relatively disposed between the first edge of the conductive sheet and the first ends for reduced electromagnetic radiation emission in a direction radiating from the second ends to the first ends.

21. A broadband microstrip antenna as in claim 20 in which the conductive wall is relatively transverse to the axis defined by the first and second ends.

22. A broadband microstrip antenna as in claim 20 in which the conductive wall is relatively perpendicular to the conductive sheet and the first and second spaced apart slot sections.

23. A broadband microstrip antenna as in claim 20 in which the conductive wall is constructed of copper.

24. A broadband microstrip antenna as in claim 20 in which electromagnetic radiation absorbing material is disposed between the conductive sheet and the first ends adjacent to the conductive wall on a side most proximate to the second edge of the conductive sheet.

25. A broadband microstrip antenna as in claim 24 in which the electromagnetic radiation absorbing material is an open cell type urethane foam loaded with carbon.

26. A broadband microstrip antenna as in claim 24 in which the electromagnetic radiation absorbing material is a graded absorber.

27. A broadband microstrip antenna as in claim 16 includes a body of electromagnetic radiation absorbing material relatively disposed between the first edge of the conductive sheet and the first ends for reduced electromagnetic radiation emission in a direction radiating from an axis defined from the second ends to the first ends.

28. A broadband microstrip antenna as in claim 27 in which the body of electromagnetic radiation absorbing material is an open cell type urethane foam loaded with carbon.

29. A broadband microstrip antenna as in claim 27 in which the body of electromagnetic radiation absorbing material is a graded absorber.

30. A broadband microstrip antenna as in claim 16 in which the resistive sheet is tapered to have a resistance that relatively increases from the first edge to the second edge.

31. A broadband microstrip antenna as in claim 16 in which the resistive sheet comprises a nonconductive material.

32. A broadband microstrip antenna as in claim 16 in which the resistive sheet is a non-conductive film.

33. A broadband microstrip antenna as in claim 16 in which the resistive sheet is coated with a conductive ink to enable it to have a tapered resistance that is relatively higher at the first edge than the second edge.

34. A broadband microstrip antenna as in claim 16 including a pair of conductive plates disposed between the conductive sheet and the first and second ends, opposed to each other and aligned along an axis defined between the first and second ends.

35. A broadband microstrip antenna as in claim 34 in which the maximum spacing of the second end is within the space defined by the conductive plates.

36. A broadband antenna of low profile enabling conformal mounting, comprising:

an open-top thermoplastic enclosure having generally imperforate bottom and side walls, and including an enclosure cavity;

a dielectric substrate of sheetlike form received in the enclosure cavity with a substrate first major surface facing outwardly from the enclosure cavity;

a copper layer deposited onto the substrate first major surface, parts of the copper layer being etched away to form a pair of slot sections with facing tapered edges separated a minimum amount at a feed point and a maximum amount at an aperture spaced from the feed point;

first and second slot portions respectively connected to the slot sections and extending in a direction away from the aperture;

an electrically resistive material applied in covering relation to the first and second slot portions;

a conductive layer disposed above said copper layer and grounded thereto; and a resistive layer extending from said conductive layer proximate to the aperture formed by the slot sections for decreasing electromagnetic radiation that would otherwise scatter from an edge of said conductive layer that said resistive layer extends from.

37. A broadband antenna as in claim 36 including a conductive wall disposed between said conductive layer and copper layer proximate to said feed point.

38. A broadband antenna as in claim 37 in which said conductive layer is grounded to said copper layer through said conductive wall.

39. A broadband antenna as in claim 37 including a block of electromagnetic radiation absorber disposed between said conductive layer and said copper layer adjacent to said conductive wall.

40. A broadband antenna as in claim 39 in which said block is open cell type urethane form loaded with carbon.

41. A broadband antenna as in claim 36 including a pair of conductive side plates disposed between said conductive layer and said copper layer so as to be relatively aligned with their respective said slot sections that extend away from the aperture for reducing electromagnetic radiation that is not directed towards the aperture.

42. A broadband antenna as in claim 41 in which said pair of conductive side plates are grounded to said conductive layer.

43. A broadband antenna as in claim 36 in which said resistive layer's resistance increases with its distance from said conductive layer.

* * * * *